US005083724A

United States Patent [19]

Kranz

[11] Patent Number: 5,083,724

[45] Date of Patent: Jan. 28, 1992

[54] DEVICE FOR CONTROLLING AERODYNAMIC BODIES

[75] Inventor: Walter Kranz, Taufkirchen, Fed. Rep. of Germany

[73] Assignee: Messerschmitt-Bölkow-Blohm GmbH, Munich, Fed. Rep. of Germany

[21] Appl. No.: 516,290

[22] Filed: Apr. 30, 1990

[30] Foreign Application Priority Data

Feb. 27, 1986 [DE] Fed. Rep. of Germany ..... 3606423

[51] Int. Cl.[5] ..... F42B 10/62

[52] U.S. Cl. ..... 244/3.21

[58] Field of Search ..... 244/3.21, 3.22, 3.1

[56] References Cited

U.S. PATENT DOCUMENTS

| | | | |
|---|---|---|---|
| 3,111,088 | 11/1963 | Fisk | 244/3.16 |
| 4,438,893 | 3/1984 | Sands et al. | 244/3.21 |
| 4,565,340 | 1/1986 | Bains | 244/3.1 |
| 4,579,298 | 4/1986 | Thomson | 244/3.21 |
| 4,898,342 | 2/1990 | Kranz et al. | 244/3.21 |
| 4,927,096 | 5/1990 | Kranz | 244/3.22 |

FOREIGN PATENT DOCUMENTS

| | | | |
|---|---|---|---|
| 3606423 | 9/1987 | Fed. Rep. of Germany | 244/3.21 |

*Primary Examiner*—Charles T. Jordan

*Attorney, Agent, or Firm*—Kenyon & Kenyon

[57] ABSTRACT

A device for controlling aerodynamic bodies with at least one setting member for generating a transversal force on the aerodynamic body. To achieve a simple compact design, setting members are arranged on a rotor where the rotor extends forward from the tip of the aerodynamic body. The setting members are arranged here so that they set the rotor in rotation by the oncoming flow; they are designed, for instance, as a crossed pair of rudders. In addition, the setting members are located asymmetrically to the longitudinal axis of the aerodynamic body, so that they exert at least in some positions of the rotor a transversal force on the aerodynamic body. The position of the rotor can be influenced by means of a braking system.

6 Claims, 3 Drawing Sheets

DEVICE FOR CONTROLLING AERODYNAMIC BODIES

BACKGROUND OF THE INVENTION

The present invention relates to a device for controlling aerodynamic bodies and claims the benefit of U.S. application Ser. No. 016,881, filed Feb. 20, 1987, now U.S. Pat. No. 4,927,096 entitled ROTOR SETTING SYSTEM IN CONJUNCTION WITH AERODYNAMIC BODY CONTROLS, and assigned to the assignee of the present application.

From DE-OS 33 17 583, a device of this type is known, in which, in a rotor arranged on the longitudinal axis of the aerodynamic body inside the aerodynamic body, a central canal is disposed which changes at the one end into a thrust nozzle and at the other end is in connection with a gas generator. The propulsion gases of the gas generator flow through the canal and the thrust nozzle the thrust axis of which does not go through the axis of rotation of the rotor so that the rotor overall is set into fast rotation. The propulsion gases flow from the thrust nozzle to the outside through several openings in the outside surface of the aerodynamic body. Due to the fast rotation, no transversal force is thereby exerted on the aerodynamic body in the average. However, the rotor can be held by means of a setting device, for instance, a magnetic braking system, in defined positions at which then a transversal force is exerted on the aerodynamic body.

This known device leads to a very compact design but requires a gas generator.

SUMMARY OF THE INVENTION

It is an object of the invention to provide a device of the type under discussion for controlling aerodynamic bodies, with which the aerodynamic body can be controlled with a minimum of technical means. In particular, the device should also be able to control a relatively small aerodynamic body, so that a simple design with only few structural components is required.

The above and other objects of the invention are achieved by a device for controlling aerodynamic bodies having at least one setting member for generating a transversal force on the aerodynamic body, the setting member being arranged at a rotor and a setting device being provided between the aerodynamic body and the rotor for adjusting the angular position of the rotor and thereby of the setting member generating the transversal force, the rotor protruding forward from the tip of the aerodynamic body; the setting member being firmly connected to the rotor and being arranged so that the setting member sets the rotor in rotation by the oncoming flow; a braking system being provided as the setting member internally to the aerodynamic body; and the setting member being located asymmetrically to the longitudinal axis of the aerodynamic body so that the setting member exerts a transversal force on the aerodynamic body at least in some positions of the rotor if the rotor is arrested.

Accordingly, the setting member is arranged on a rotor protruding from the tip of the aerodynamic body and is firmly connected thereto. By the asymmetrical arrangement of the setting member relative to the longitudinal axis of the aerodynamic body, the rotor is set in rotation by the oncoming flow but can be held in any position by a braking system. In at least some of these positions, a transversal force can be exerted on the aerodynamic body.

BRIEF DESCRIPTION OF THE DRAWINGS

The invention will be described in greater detail in the following detailed description with reference to the drawings, in which.

DETAILED DESCRIPTION

Figure 1:
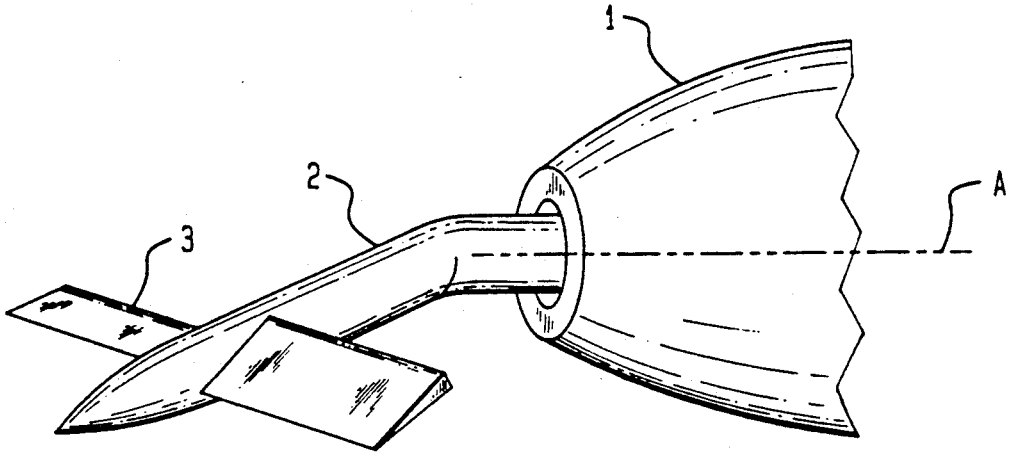
FIG. 1 shows a partial schematic view of the front part of an aerodynamic body with a bent-off rotor protruding from the tip of the aerodynamic body, on which a crossed pair of rudders is arranged outside the axis of the aerodynamic body.
Figure 2:
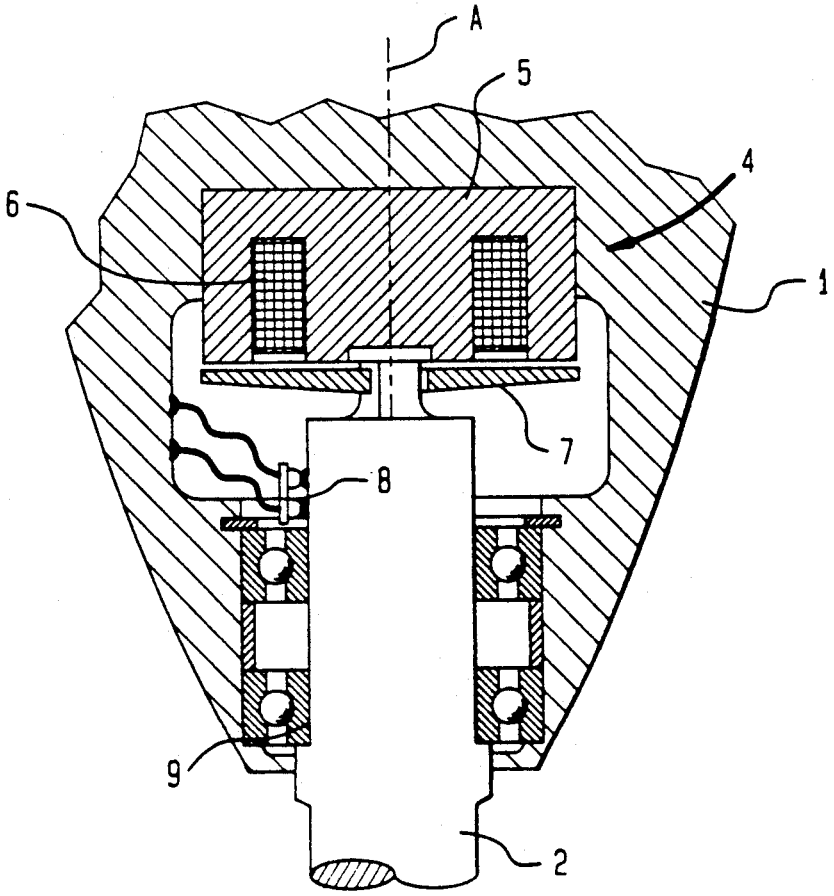
FIG. 2 shows a section through the tip of the aerodynamic body with a braking system for the rotor.

In an aerodynamic body tip 1 shown in FIG. 1, a bent-off rotor 2 is supported, where the rotor axis is located within the aerodynamic body tip 1 on the longitudinal axis A of the aerodynamic body and the part of the rotor 2 which extends forward and is bent relative to the longitudinal axis A of the aerodynamic body comprises mutually crossed rudders 3. For the rotor 2, a braking system 4 is provided which is shown in FIG. 2 and comprises an electromagnet 5 with a coil 6. With the forward-pointing poles of the electromagnet is associated a braking disc 7 which is connected to the rotor 2. The angular position of the rotor may be scanned via sliders 8 or another suitable means. The rotor itself is supported in a bearing 9.

If the braking system 4 is not actuated, the bent-off rotor rotates freely at high speed about the longitudinal axis of the aerodynamic body. If the bent-off rotor is stopped by the braking system 4, a transversal force acts on the aerodynamic body according to a pitch moment through the off-center position of the rudders 3.

The rotor 2 may be hollow so that its inertia is low and high speeds of rotation are reached.

If no transversal force is to be exerted on the aerodynamic body, i.e., a command zero is present, the rotor 2, with the braking system 4 inactive, rotates at high speed, so that the sum of all transversal forces is zero. The same thing can be achieved if the braking system 4 is switched-on continuously or is driven by means of pulse width modulation, without the rotation of the rotor 2 being prevented. If a transversal force is to be exerted on the aerodynamic body, the speed of rotation can be reduced by activation of the braking system 4 when the desired transversal force direction is being traversed. If the braking system 4 is continuously switched on to the command zero or is driven via pulse width modulation, the same effect can be achieved by releasing the braking system 4, i.e., increased speed of rotation of the rotor 2 in all non-desired transversal force directions.

However, the aerodynamic body is braked by the bentoff rotor and the crossed pair of blades 3 located outside the longitudinal axis of the aerodynamic body.

Figure 3A:
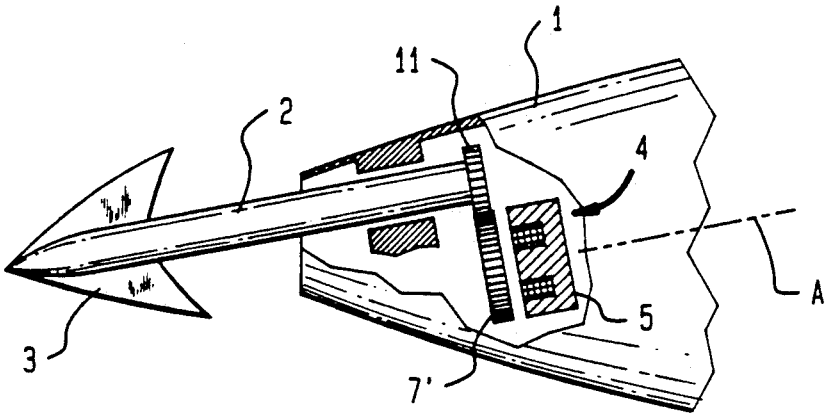
FIGS. 3*a* and 3*b* show schematically a cross section through the tip of an aerodynamic body with a rotor inclined relative to the longitudinal axis with two rudders crossed relative to each other.
Figure 3B:
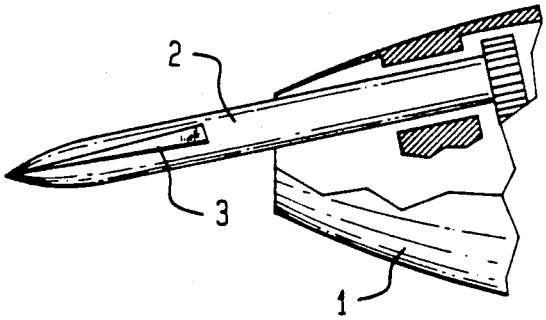

According to FIGS. 3*a* and 3*b*, a slim straight rotor 2 is supported in the top 1 of the aerodynamic body, whose axis of rotation is inclined relative to the longitudinal axis A of the aerodynamic body. The rotor 2 carries at its front end which is approximately located on the longitudinal axis of the aerodynamic body, a crossed pair of blades 3, so that the rotor 2 is set in fast rotation when the aerodynamic body is in flight. By the described arrangement, interference forces on the aerodynamic body are avoided here for all practical purposes.

If a transversal force is to be exerted on the aerodynamic body in a certain direction, the rotor 2 is stopped by means of a braking system 4 which consists of a magnet 5 and a geared braking disc 7' which meshes with a gear 11 at the end of the rotor 2 on the aerodynamic body side. The then stopped crossed pair of blades 3 exerts, according to FIG. 3*b*, a transversal force on the aerodynamic body 1, where the direction in space of this transversal force can be determined according to the stopped position of the rotor 2. With this system a full command is possible only once during a rotation of the aerodynamic body 1 if the later rotates.

Also in this control device, the rotor 2 is of low inertia design. Upon a command zero, the plane of the pair of rudders is aimed through the longitudinal axis of the aerodynamic body (FIG. 3*a*), so that the braking effect of the aerodynamic body is small. In case of a command, the plane of the pair of rudders forms an angle with the longitudinal axis of the aerodynamic body.

The described device is of simple design.

Figure 4:
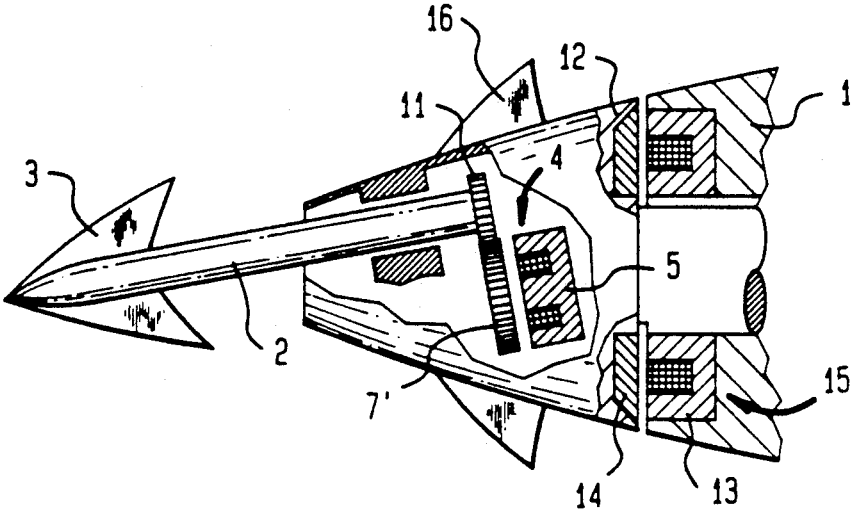
FIG. 4 shows a variant of the aerodynamic body shown in FIGS. 3*a* and 3*b*, in which the top of the aerodynamic body is additionally rotatable relative to the rest of the aerodynamic body housing.
Figure 5A:
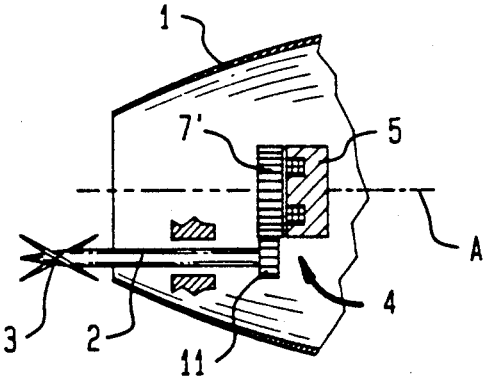
FIGS. 5*a* to 5*d* show cross sections and front views, respectively, of a part of an aerodynamic body with a rotor which is arranged parallel to the longitudinal axis of the aerodynamic body and carries a crossed pair of rudders.
Figure 5B:
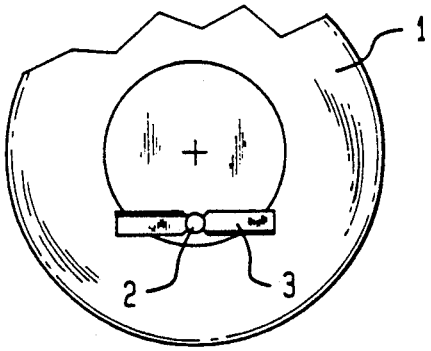
Figure 5C:
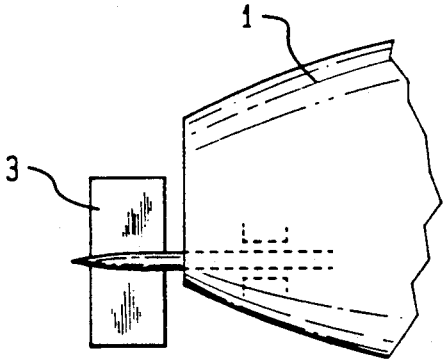
Figure 5D:
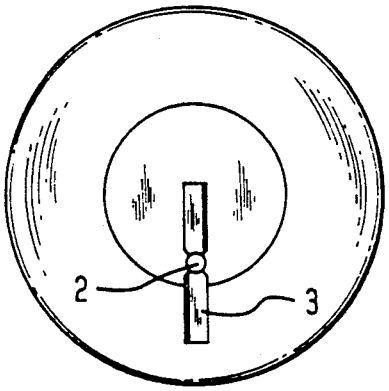

The control device according to FIG. 4 resembles that according to FIGS. 3*a* and 3*b* and accordingly again comprises a rotor 2 with an angle relative to the longitudinal axis of the aerodynamic body, which carries in front a crossed pair of rudders 3 and is equipped at its rear end with a gear 11 which meshes with a geared braking disc 7'. The braking disc 7' cooperates with an electromagnet 5 of the braking system 4. The rotor 2 and the braking disc 4 are in turn contained in a rotary part 12 which forms part of the aerodynamic body tip. This rotary part 12 is braced against the rest of the aerodynamic body 1. In the aerodynamic body housing 1 is provided a ring magnet 13 with which a braking disc 14 is associated on the side of the rotary part 12. The ring magnet 13 and this braking disc 14 form a further braking system 15. The rotary part 12 itself is continuously kept in rotation by crossed rudders 16 unless the second braking system 15 is actuated. With this design, a transversal force fixed in space can continuously be exerted also if the aerodynamic body rotates. Instead of the braking system 15, an electric motor can also be provided between the rotary part 12 and the rest of the aerodynamic body housing 1, so that the rotating part can be driven actively.

In principle, the necessary rudder area of the crossed rudders is decreased with increasing distance from the center of gravity of the aerodynamic body; the moment of inertia of the rudder is reduced thereby and the switching process between a zero command and the command, and the command and zero command takes place faster. The transversal force can likewise be furnished by small rudder surfaces. It is possible to push the rotor 2, for instance, after launching the aerodynamic body from a launching tube, for which purpose, for instance, the deceleration of the aerodynamic body can be utilized. In such a case, the rotor 2 protruding otherwise from the top of the aerodynamic body does not impede the manipulation of the aerodynamic body. It should further be mentioned that the rotor 2 itself generates buoyancy, whereby the rudder area can be reduced additionally.

In an aerodynamic body 1 according to FIGS. 5*a* to 5*d*, the rotor 2 is supported parallel to the longitudinal axis A of the aerodynamic body, the rotor 2 being set in rotation by a crossed pair of rudders or spoilers 3 at the tip. On the other side of the rotor 2 in the interior of the aerodynamic body, a gear 11 is again provided, which meshes with a geared braking disc 7'. The geared braking disc 7' is again part of a braking system 4 with an electromagnet 5 according to FIG.. 2. In the event of a command of 100%, the crossed pair of spoilers 3 is held, according to FIGS. 5*a* and 5*b*, in a plane parallel to the transversal plane of the aerodynamic body; in case of a zero command, the spoiler pair 3 is held in the vertical plane of the aerodynamic body; see FIGS. 5*c* and 5*d*. In case of a full command according to FIGS. 5*a* and 5*b*, the on-flowing air impinges on the front surface, designed as an impact surface, of the aerodynamic body and on the other hand, is conducted past the pair of spoilers 3 so that, in the example shown, a pitch command adjusts itself. In the case of the zero command according to FIGS. 5*c* and 5*d*, the flow around the aerodynamic body is relatively symmetrical and only the part of the spoiler pair protruding from the outer contour of the aerodynamic body forms a small resistance.

Figure 6A:
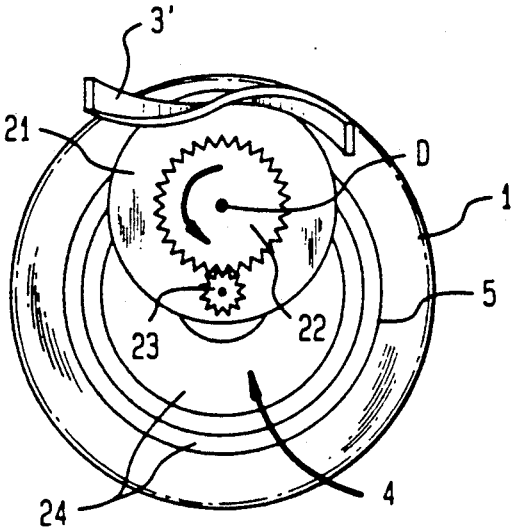
FIGS. 6*a* and 6*b* show a top view onto the tip of an aerodynamic body partially broken open, with a rotor carrying a crossed spoiler.
Figure 6B:
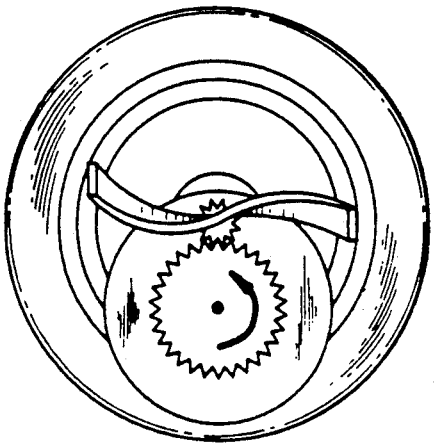

In FIGS. 6*a* and 6*b*, a top view onto the tip of the aerodynamic body 1 is shown, parts having been broken away for the sake of clarity. A spoiler 3' designed as a turned sheet metal strip is mounted on a spoiler carrier 21 and is located at the outside circumference of the aerodynamic body 1 shown in FIG. 6*a*. To the spoiler carrier 21 is connected a gear which is designed as an armature and rotates above the axis of rotation D of the spoiler carrier 21. This armature gear meshes with a further gear 23 which is firmly connected to a braking magnet 5 on the side of the aerodynamic body. Magnet poles 24 of the braking magnet are indicated. This design can be considered as a kind of planetary gear. By suitable rotation of the spoiler carrier 21 and running of the individual gears on each other, the spoiler 3' can be transferred on a desired curve in space from the position according to FIG. 6*a* into a position centered on the aerodynamic body according to FIG. 6*b*. This position corresponds to the zero command, and the position according to FIG. 6*a* to a full command.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A device for controlling aerodynamic bodies with at least one setting member for generating a transversal force on the aerodynamic body, the setting member being arranged at a rotor and a setting device being provided between the aerodynamic body and the rotor for adjusting the angular position of the rotor and thereby of the setting member generating the transversal force, the rotor protruding forward from the tip of the aerodynamic body, and having a shape for causing the setting member to exert the transversal force on the aerodynamic body, with the rotor having at least a portion that has a longitudinal axis different from that of the aerodynamic body, and with that portion having a crossed pair of rudders attached thereto and with the rudders being associated with the setting member; the setting member being connected to the rotor and being arranged so that the setting member sets the rotor in rotation by the oncoming flow; a braking system being provided as the setting device internally to the aerodynamic body; and the setting member being located asymmetrically to the longitudinal axis of the aerodynamic body so that the setting member exerts a transversal force on the aerodynamic body at least in some positions of the rotor if the rotor is arrested.

2. The device recited in claim 1, wherein the braking system comprises an electro-magnet and a braking disc facing the poles of the electro-magnet as an armature.

3. The device recited in claim 1, wherein the rotor is hollow.

4. A device for controlling aerodynamic bodies with at least one setting member for generating a transversal force on the aerodynamic body, the setting member being arranged at a rotor and a setting device being provided between the aerodynamic body and the rotor for adjusting the angular position of the rotor and thereby of the setting member generating the transversal force, the rotor protruding forward from the tip of the aerodynamic body; the setting member being connected to the rotor and being arranged so that the setting member sets the rotor in rotation by he oncoming flow; a braking system being provided as the setting device internally to the aerodynamic body; the setting member being located asymmetrically to the longitudinal axis of the aerodynamic body so that the setting member exerts a transversal force on the aerodynamic body at least in some positions of the rotor if the rotor is arrested, the rotor being located on the longitudinal axis of the aerodynamic body, being bent-off outside the aerodynamic body, and having a crossed pair of rudders coupled to both sides of the bent-off region.

5. The device recited in claim 4, wherein the braking system includes an electro-magnet and a braking disk facing the poles of the electro-magnet as an armature.

6. The device recited in claim 4, wherein the rotor is hollow.

* * * * *